United States Patent [19]

Hirata

[11] Patent Number: 4,518,271

[45] Date of Patent: May 21, 1985

[54] PRINTER WITH MOVEABLE CARRIAGE ACTUATING PINCH ROLLER TO RELEASE POSITION

[75] Inventor: Yoshikatsu Hirata, Nagoya, Japan

[73] Assignee: Brother Kogyo Kabushiki Kaisha, Nagoya, Japan

[21] Appl. No.: 625,228

[22] Filed: Jun. 27, 1984

[30] Foreign Application Priority Data

Jul. 15, 1983 [JP] Japan ..... 58-129657

[51] Int. Cl.[3] ..... B41J 13/02

[52] U.S. Cl. ..... 400/636.1

[58] Field of Search ..... 400/636, 636.1, 637.1, 400/638, 639.2, 645.3, 645.4, 645.5, 647, 631

[56] References Cited

U.S. PATENT DOCUMENTS 4,221,489 9/1980 Engle et al. ..... 400/647 X
4,425,047 1/1984 Narushima ..... 400/636 X
4,437,780 3/1984 Weber et al. ..... 400/636.1

FOREIGN PATENT DOCUMENTS 3209085 10/1982 Fed. Rep. of Germany ... 400/636.1
59877 4/1983 Japan ..... 400/636.1

*Primary Examiner*—E. H. Eickholt
*Attorney, Agent, or Firm*—Moonray Kojima

[57] ABSTRACT

A printer having a carriage with a printing head mounted thereon which is moved in a printing region for performing printing operation. The printer comprises a paper holding device having a plurality of pressure rollers and being rotatably supported between a closed position wherein the pressure rollers abut on a platen, and an open position wherein the abutting of the rollers against the platen is released, an urging member to urge the paper holding device at least towards the closed position, and an actuating means being operated while the carriage is moved to one side out of the printing region and moving the paper holding device from the closed position to the open position.

8 Claims, 3 Drawing Figures

PRINTER WITH MOVEABLE CARRIAGE ACTUATING PINCH ROLLER TO RELEASE POSITION

BACKGROUND OF THE INVENTION

1. Field of Invention

This invention relates to printers having a carriage with a printing head mounted thereon which is moved along a printing surface of a platen to perform printing operation; and more particularly to a paper holding device which is suitable for use in such printers.

2. Description of Prior Art

Generally, a paper holding device is required for a printer to hold a printing paper against a printing surface of a platen and to constantly keep a suitable spacing between the top end of the printing head and the paper during printing operation, by preventing the paper from rising above the platen surface, so that fine, accurate printing may be performed.

Also, in order to change the paper after completion of printing, the paper holding device must be moved from a closed position whereat the paper is pressed against the platen, to an open position whereat the paper is released from the platen. In conventional printers, the opening and closing of such paper holding device is carried out by a solenoid of usual construction, which tends to be complex and requiring numerous parts. This is costly and uneconomical.

SUMMARY OF THE INVENTION

An object of the invention is to provide a paper holding device for use in printers which is simple in construction and is of low cost.

Another object is to provide a paper holding device for use in printers which can carry out opening and closing operations by utilizing movement of the carriage.

DETAILED DESCRIPTION OF PREFERRED EMBODIMENTS

Figure 1:
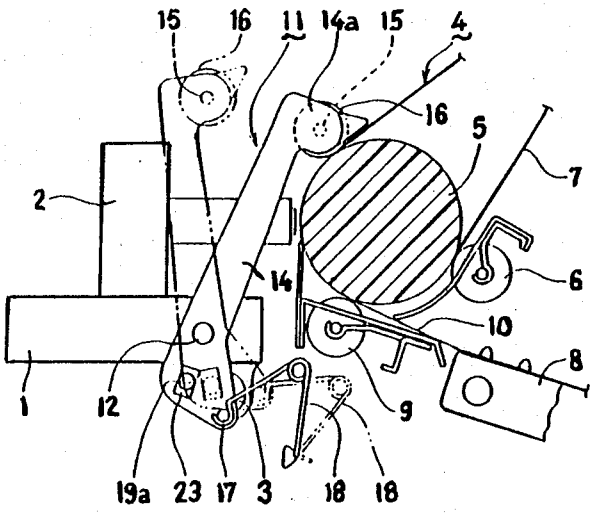
FIG. 1 is a right side vice depicting an illustrative embodiment of the invention.
Figure 2:
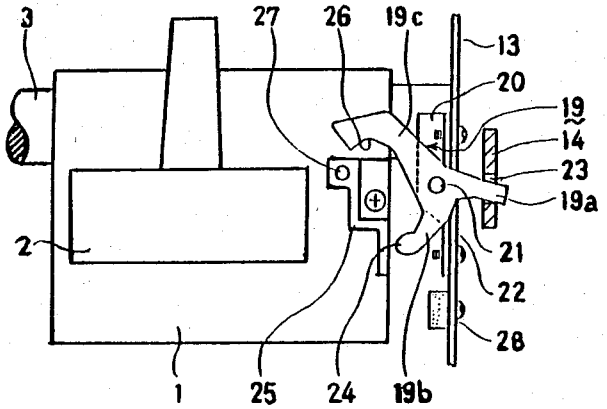
FIG. 2 is a plan view of the illustrative embodiment of FIG. 1., in a closed position.
Figure 3:
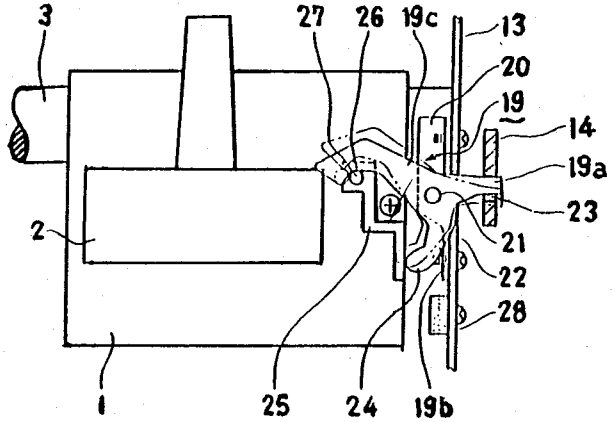
FIG. 3 is a plan view of the illustrative embodiment of FIG. 1, in an open position.

Referring to FIGS. 1, 2 and 3, a printer is depicted comprising a carriage 1 with an upper surface having a printing head 2 mounted thereon. Carriage 1 is guided by a guide bar 3 and reciprocated so that printing head 2 is moved along a printing surface of a platen 5 on which a printing paper 4 is installed. Paper 4 may be suitably selected from a unit paper 7 fed by cooperative action of roller 6 and platen 5, or a continuous paper 10 fed by cooperative action of a tractor 8, roller 9 and platen 5.

A paper holding device 11 is supported at both sides, in the longitudinal direction of platen 5, by a pair of side frames 13 so that it is pivotable about a shaft 12 and movable about between a closed position (shown by solid line in FIG. 1) and an open position (shown by dash and dot line in FIG. 1). Paper holding device 11 comprises a pair of levers 14 pivotally supported by side frames 13, a roller shaft 15 supported by a roller supporting portion 14*a* of lever 14, and a plurality of pressure rollers 16 rotatably supported by roller shaft 15. Lever 14 is urged by a positioning spring 18 hooked between a pin 17 provided on lower end of lever 14 and side frame 13 so that lever 14 is held to either the closed position, whereat pressure roller abuts to paper 4 on platen 5 (as shown by solid line in FIG. 1) or the open position (as shown by dot-dash line in FIG. 1), whereat the abutting state of roller 16 to paper 4 is released.

An actuating lever 19, of a three arm type, is pivotally supported by a pin 21 mounted (see FIG. 3) on a supported member 20 fixed with a screw on one side wall of side frame 13. Lever 19 comprises first arm 19*a*, second arm 19*b* and third arm 19*c*. Arm 19*a* passes through opening 22 bored in frame 13 and is loosely fitted to an aperature 23 formed on lower end of lever 14. Arm 19*b* has a projection 24 formed on a top end thereof. When carriage 1 is moved to the right and gets near right side frame 13, projection 24 abuts on an abutting member 25 fixed with a screw on lateral edge of carriage 1. Arm 19*c* has an engaging cam 26 which is engagable with an engaging pin 27 which stands upright on abutting member 25 according to abutting action between projection 24 and abutting member 25 as carriage 1 is moved to the right. Stopper 28 prevents carriage 1 from colliding with side frame 13 when carriage 1 is moved to the right.

In operation, as carriage 1 is moved, head 2 is driven so as to perform prescribed printing on paper 4. Then, lever 14 is urged and held at the closed position by means of positioning spring 18, and paper 4 is pressed against the surface of platen 5 by means of roller 16. During such printing operation, even when the printing region (right margin) of head 2 is set to a maximum printing column and printing is performed, projection 24 of second arm 19*b* of lever 19 does not abut abutting member 25.

In order to change paper 4 after completion of printing, carriage 1 is moved to the right beyond the maximum printing column. As carriage 1 is moved in such manner, projection 24 of second arm 19*b* abuts on abutting member 25 and lever 19 is rotated in a counterclockwise direction in FIG. 2, whereby engaging cam 26 and engaging pin 27 are engaged as shown in FIG. 3 by the solid line. Since first arm 19*a* is loosely fitted to aperature 23 of lever 14, lever 14 is rotated about shaft 12 from the closed position to the open position on basis of rotational movement of lever 19 . At the open position, lever 14 is urged and held by means of engaging action between engaging pin 27 and engaging cam 26, and positioning action of positioning spring 18.

Next, paper 4 is changed while lever 14 is held to the open position. Then, carriage 14 is moved to the left in FIG. 3. As carriage 1 is moved to the left, engaging pin 27 gets over the bottom end of third arm 19*c* and is released from engagement cam 26 (shown by dash dot line in FIG. 3). At the same time, since abutting state between projection 24 of second arm 19*b* and abutting member 25 is released, lever 19 is moved to the position shown by FIG. 2. Thus, lever 14 is returned to the closed position.

In this embodiment, positioning spring 18 is so designed that it can get over the dead point by the rotation amount of lever 14 based on movement of first arm 19*a* when engaging pin 27 gets over the bottom end of third arm 19*c* (as shown by dash dot line in FIG. 3). The state of positioning spring 18 is changed to the dash-dot line state of FIG. 1 by urging force of spring 18. Thus, the prescribed printing is performed again on a new paper and the foregoing operation is repeated.

The foregoing description is illustrative of the principles of the invention. Numerous modifications and extensions thereof would be apparent to the worker skilled in art. All such modifications and extensions are to be considered to be within the spirit and scope of the invention.

What is claimed is:

1. A printer having a plurality of side frames, a platen having a printing surface rotatably supported by said side frames, and a carriage supporting a printing head and being movable along said printing surface of said platen, wherein said carriage is movable in a printing region and at the same time printing is performed by said printing head, said printing comprising a paper holding device having a plurality of pressure rollers and being supported by said side frames so as to be rotatable between a closed position wherein said pressure rollers abut said platen and an open position wherein said abutting of said rollers against said platen is released;

an urging means for urging said paper holding device at least towards said closed position; and an actuating means being operated while said carriage is moved to one side out of said printing region and for moving said paper holding device from said closed position to said open position.

2. The printer of claim 1, wherein said actuating means comprises an actuating lever having one end thereof engaging with said paper holding device and being rotatably supported on one of said side frames out of said printing region, and an engaging member installed on said carriage for rotation of said actuating lever in order to move said rollers of said paper holding device from said closed position to said open position when said carriage is moved to one side out of said printing region.

3. The printer of claim 1, wherein said holding device comprises a pair of levers, each of which is rotatably supported by one of said side frames, respectively; a roller shaft supported between said levers; and a plurality of rollers being rotatably supported on said roller shaft.

4. The printer of claim 3, wherein said urging member is a spring with one end thereof hooked to one of said side frames and another end thereof hooked to said lever.

5. The printer of claim 4, wherein said actuating means comprises an actuating lever having one end thereof engaging with said paper holding device and being rotatably supported on one of said side frames at a position out of said printing region, and an engaging member installed on said carriage for rotating said actuating lever in order to move said rollers through said lever from said closed position to said open position when said carriage is moved to one side out of said printing region.

6. The printer of claim 5, wherein said spring has a first state for supplying said lever with an urging force to urge said roller towards said closed position with respect to a dead center as a borderline and a second state for supplying said lever with urging force to urge said roller towards said open position.

7. The printer of claim 6, wherein said printer further comprises means disposed between said actuating lever and said engaging member, for supplying said actuating lever with a rotation amount to move said spring from said first state to said second state when said carriage is moved from a position out of said printing region to a position in said printing region.

8. The printer of claim 7, wherein said means of said printer comprises a pin suppoted by said engaging member and a cam surface provided at another end of said actuating lever.

* * * * *